US005328113A

United States Patent [19]

de Chevron Villette et al.

[11] Patent Number: 5,328,113

[45] Date of Patent: Jul. 12, 1994

[54] DEVICE FOR WINDING THE SUSPENSION CORD OF A BLIND

[75] Inventors: Jean de Chevron Villette, Annecy le Vieux; Jean-Michel Perache, Sallanches; Marc Quezel, Passy, all of France

[73] Assignee: Somfy, France

[21] Appl. No.: 6,652

[22] Filed: Jan. 21, 1993

[30] Foreign Application Priority Data

Jan. 30, 1992 [FR] France ..... 92 01036

[51] Int. Cl.[5] ..... B65H 54/02; A47H 3/00

[52] U.S. Cl. ..... 242/388; 160/170; 160/319

[58] Field of Search ..... 242/54 R, 77, 100; 160/170, 171, 193, 319, 320, 322

[56] References Cited

U.S. PATENT DOCUMENTS

| | | | |
|---|---|---|---|
| 2,930,539 | 3/1960 | Bremer | 242/54 R |
| 4,262,854 | 4/1981 | Jett | 242/54 R |
| 4,623,012 | 11/1986 | Rude et al. | 160/171 |
| 4,721,833 | 1/1988 | Dubay | 242/54 R |

FOREIGN PATENT DOCUMENTS

| | | | |
|---|---|---|---|
| 380346 | 8/1990 | European Pat. Off. | E06B 9/32 |
| 1234045 | 10/1960 | France . | |
| 1319645 | 1/1963 | France . | |
| 400816 | 4/1966 | Switzerland . | |
| 408694 | 9/1966 | Switzerland . | |

*Primary Examiner*—Daniel P. Stodola
*Assistant Examiner*—John Q. Nguyen
*Attorney, Agent, or Firm*—Laff, Whitesel, Conte & Saret

[57] ABSTRACT

The device includes a winding drum (1) on which there is fixed one end of the cord to be wound. This drum includes a smooth portion (8) having a diameter which is greater than the initial diameter of the drum (1), is located at a distance from the cord fixing point (12) and is limited by a shoulder (9). The cord (11) to be wound is guided approximately tangentially to this shoulder so that the turns (11a) formed on the portion of greater diameter are pushed back by the shoulder (9) under the effect of the load, the length of the portion of greater diameter (8) being such that the tension on the cord is zero in the turns (11*b*) leaving this portion of greater diameter. These loose turns are positioned beside each other on the portion (1) of the drum ensuring an even winding without overlapping of the cord.

11 Claims, 2 Drawing Sheets

Fig 5
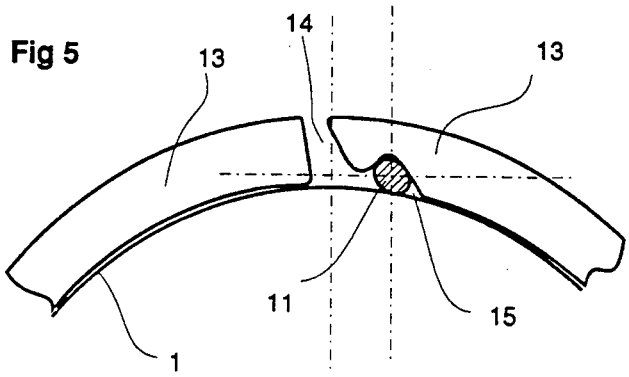
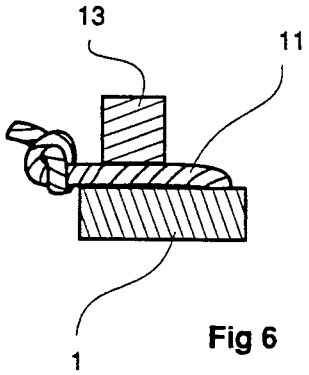
Fig 6
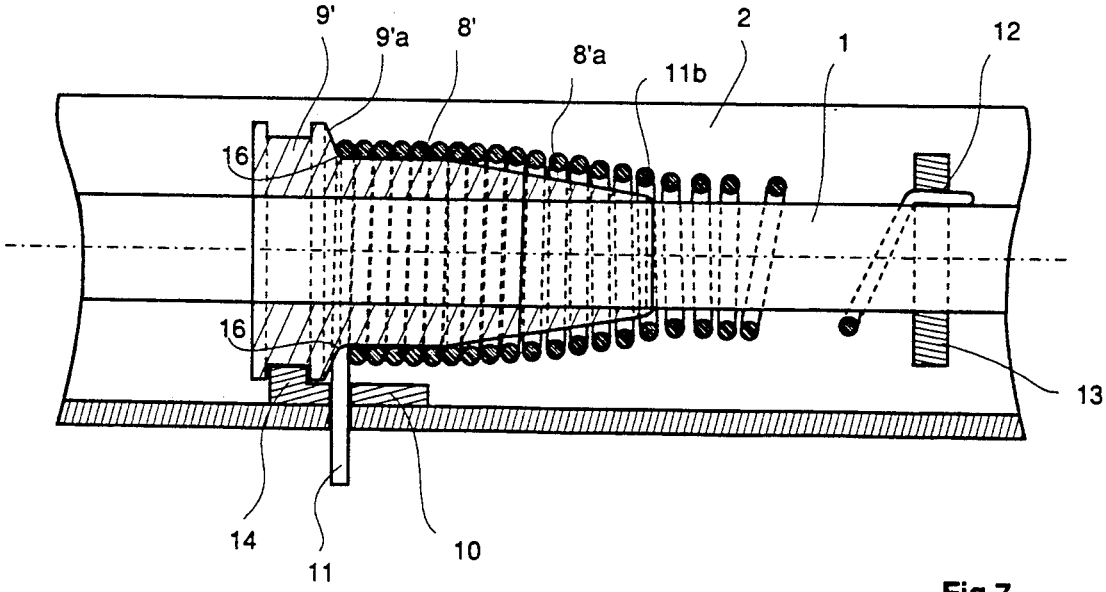
Fig 7

DEVICE FOR WINDING THE SUSPENSION CORD OF A BLIND

FIELD OF THE INVENTION

The subject of the invention is a device for winding the suspension cord of a blind including a winding drum, on which there is fixed the end of at least one suspension cord, and means for ensuring that the cord is wound in even turns without overlapping.

PRIOR ART

Blinds, whether they are awnings, venetian blinds, folded blinds or the like, generally comprise two suspension cords, one end of which is fixed to the winding drum and the other end of which is fixed to the free end of the blind. In order to ensure an even winding and unwinding of the blind, that is to say a lowering and a raising which are equal on both sides of the blind, for esthetic reasons and for mechanical reasons (possibility of jamming), it is necessary to ensure an even winding of the two suspension cords on the winding drum, in even turns, without overlapping. For this purpose, it is known to move the winding drum with a motion of translation at the same time as the motion of rotation and of amplitude so that this translation is at least equal to the value of the diameter of the cord per revolution of the drum. Such embodiments are described in Patents FR 1 234 045, FR 1 319 645, CH 400 816, CH 408 694 and EP 380 346. The winding drum which can move axially comprises a threaded portion at one end. A corresponding threaded portion must be provided on its support. On the other side, which is to be used for its driving, an arrangement must be provided for allowing simultaneously the driving in rotation and the translation induced by the threaded portions. All this is a source of complications and extra costs. In addition, the spaces necessary for the axial displacement must be left free and in certain embodiments (CH 400 816), they form clearances which increase the overall size of the blind support.

Furthermore, in venetian blinds equipped with a device for tilting the slats, it is necessary to provide arrangements for preventing, during operation, interference between the turns of the suspension cord and the strings of the tilting device. In Patent CH 400 816, the tilting device is isolated in a cradle. In Patent FR 1 319 645, either a ring or a partition is provided. In Patent EP 380 346, a cradle makes it possible to isolate the ladder and its mechanism between two rings which has the effect of creating permanent translational friction, resulting in wear and noise.

Finally, when it is desired to place several blinds side by side, for example to equip oriel windows, and to use the driving motor of one of them for all the blinds, it is almost impossible to produce a simple kinematic link between the drums of the various blinds.

SUMMARY OF THE INVENTION

The aim of the invention is to overcome the above mentioned disadvantages.

For this purpose, the winding device according to the invention is one wherein said means for ensuring that the cord is wound in even turns without overlapping consist, on the one hand, of a smooth drum portion having a diameter which is greater than the initial diameter of the winding drum and located at a distance from the cord fixing point, this portion of greater diameter being limited, on the opposite side to the cord fixing point, by a shoulder, and, on the other hand, by means for guiding the cord which are arranged in such a way as to cause the cord to be wound onto the portion of greater diameter at least approximately against said shoulder, so that the turns formed on the portion of greater diameter are pushed back by the turn being formed under the effect of the load and of the reaction of the shoulder on the cord, the length of the portion of greater diameter being such that the tension on the cord is zero in the turns leaving this portion of greater diameter.

By very simple means, it is thus possible to obtain a winding such that the turns leaving the greater diameter of the winding drum are loose and subjected exclusively to the thrust from the turns wound on the portion of greater diameter and are aligned without resistance, like rings, on the drum of initial diameter.

The efficient length of the portion of greater diameter undoubtedly depends on the coefficient of friction of the cord on this portion, that is to say on the materials and surface finishes, but this length is not a precise and critical length, so that it is easily obtained after a few trials.

The attached drawing shows, by way of example, two embodiments of the invention.

BRIEF DESCRIPTION OF THE DRAWINGS

FIG. 5 depicts a means for fixing the end of the cord on the winding drum.

FIG. 6 is a detailed view, in cross-section along VI—VI in FIG. 5.

FIG. 7 depicts a second embodiment of the winding means.

DESCRIPTION OF THE PREFERRED EMBODIMENTS

Figure 1:
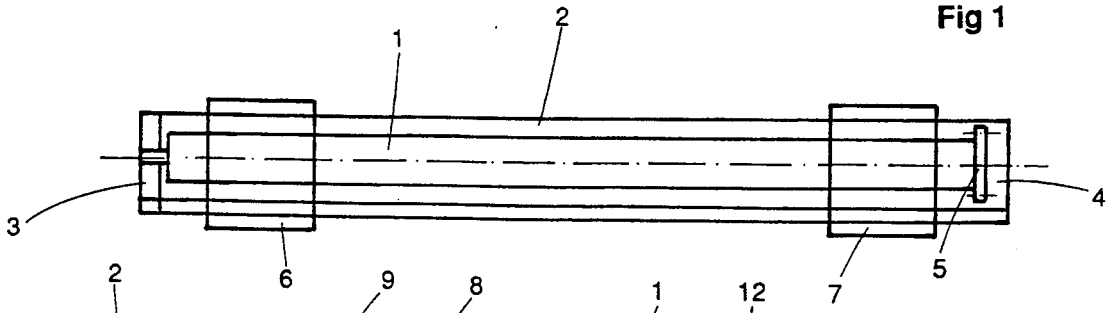
FIG. 1 is a diagrammatical view of a blind winding drum.

FIG. 1 depicts diagrammatically a winding drum 1 mounted in a casing 2 closed at its ends by two end-pieces 3 and 4 between which the winding drum 1 is mounted. On the side of the end-piece 4, the drum 1 is mounted via a driving motor 5. Two cords of the blind (not shown) are wound on the drum 1 and two devices 6 and 7 ensure that this winding is even.

Figure 2:
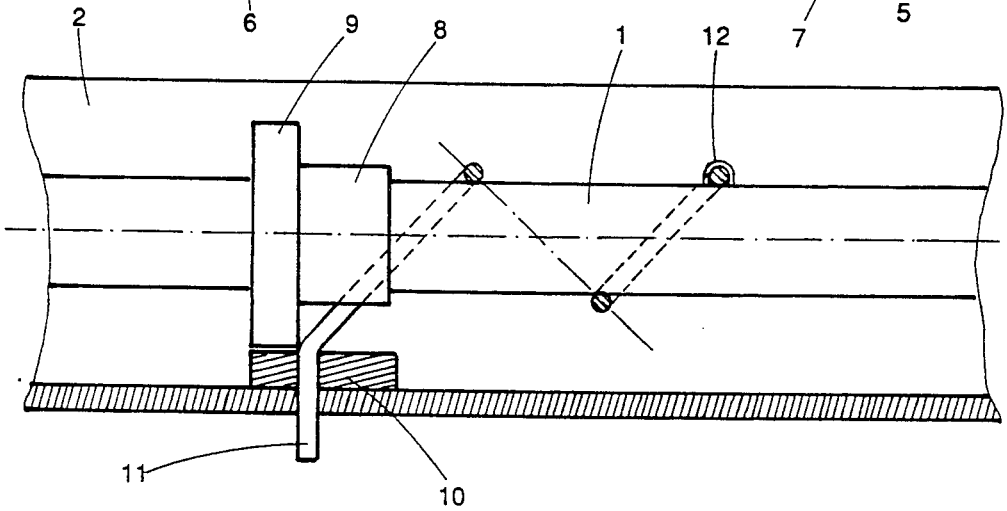
FIG. 2 is a partial view depicting a first embodiment of the means for winding the cord in even turns, in the completely unwound position.

One of these devices is depicted in FIG. 2. It consists of an auxiliary drum 8 having a diameter which is greater than the diameter of the winding drum 1 and is mounted on the drum 1. This auxiliary drum 8 is limited on one side by a shoulder 9 extending radially to the auxiliary drum 8. The device further includes a guide 10 guiding the suspension cord 11 penetrating into the casing 2 substantially radially onto the winding drum and tangentially to the lateral face of the shoulder 9. The cord 11 is fixed by one of its ends at a point 12 on the winding drum 1, at a certain distance from the auxiliary drum 8. The diameter of the auxiliary drum 8 is slightly less than the diameter of the drum 1 plus twice the diameter of the cord 11. As for the length of the auxiliary drum 8, it is determined by the effect which it is desired to obtain and which will be described hereafter.

Figure 3:
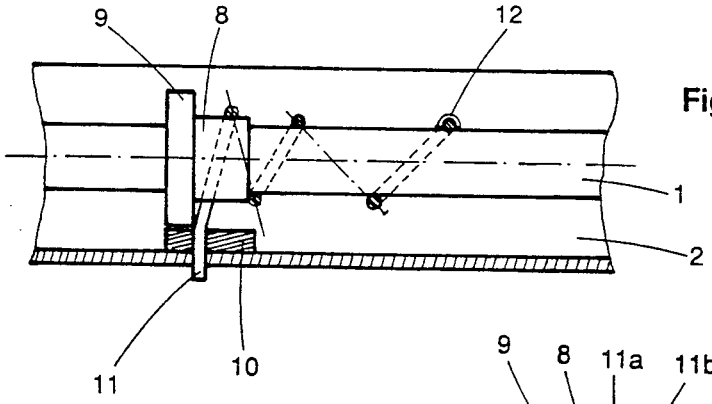
FIG. 3 depicts the same means at the beginning of the winding operation.
Figure 4:
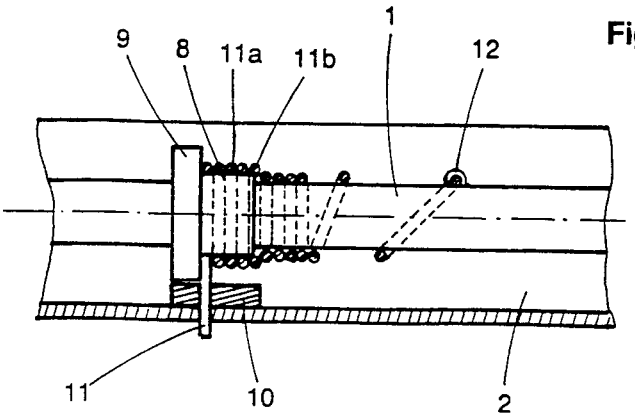
FIG. 4 depicts the same means after several revolutions of the winding drum.

When the cord 11 is wound under load, starting from the position depicted in FIG. 2, it starts to be wound around the auxiliary drum 8 as depicted in FIG. 3. The first turns are formed on the drum 8 and very rapidly come into contact with the shoulder 9. From this point onward, the turn being formed on the auxiliary drum 8 tries to insert itself between the shoulder 9 and the turn which has just been formed and the latter is pushed back under the effect of the reaction of the shoulder 9 on the turn being formed. The pushed-back turn in turn pushes the other turns 11*a* which are already formed on an auxiliary drum 8. The length of the auxiliary drum 8 is selected so that the tension on the cord is zero in the turns 11*b* leaving the auxiliary drum, so that the turns 11*b* which continue to be pushed back by the turns being formed on the auxiliary drum 8 are loose and are aligned without resistance on the winding drum 1 of initial diameter. This suppression of the tension force on the cord in the turns 11*b* is a result of the addition of the friction forces in the successive turns 11*a* formed on the auxiliary drum 8. It is thus possible to wind the cord in even turns on the winding drum 1 in an unlimited manner, and in particular until the cord 11 is completely wound.

It is understood that the length of the auxiliary drum 8 must therefore reach a minimum value so that the tension on the turns 11*b* is zero. This length may however exceed this minimum value without jeopardizing correct operation of the device.

Unwinding takes place in the same way as a thread on a reel. Since the turns are wound evenly, unwinding takes place in an even manner.

The end 12 of the cord 11 may be fixed on the winding drum 1 as depicted in FIGS. 5 and 6. The cord 11 is fixed by means of a split ring 13 tightly clasping the winding drum 1. This slit ring 13 has a slit 14 enabling the cord to pass and a notch 15 facing the drum and the bottom of which clamps the cord 11 against the drum 1. The end of the cord is further secured by a knot. The fixing ring 13 makes it possible to immobilize the cord at any position depending on the length of the cord to be wound and also to immobilize cords of different diameters.

According to the second embodiment depicted in FIG. 7, the auxiliary drum 8' is connected to the diameter of the winding drum 1 by a conical portion 8'*a* which has the effect of evening the axial displacement of the turns 11*b*. The shoulder 9' has a conical lateral face 9'*a* which makes it possible to direct more accurately the cord 11 arriving on the auxiliary drum 8'. The conical face 9'*a* is joined to the auxiliary drum 8' by a rounded portion 16 having a radius which is substantially equal to the radius of the section of the cord. This choice proved to be particularly advantageous to the operation of the device. The guide 10 is made in one piece with a cradle 14 in which the drum rotates.

The cradle 14 may be common to that of the device for tilting the slats of a venetian blind.

The device may be used with great flexibility since it can accommodate large values of length of cord to be wound without modification, and therefore blinds of various heights. It is only necessary to move the point 12 where the cord is fixed on the drum 1. There is no risk of interference between the cord and the strings for tilting the slats of a venetian blind, since there is no motion of translation of the drum and the two devices are naturally completely separate. It is also easy to link the drums of several blinds which are to be controlled by the same motor by means of a simple link of the cardan type.

According to an illustrative embodiment, the drum 1 has a diameter of 28 mm and the auxiliary drum 8 a diameter of 29.5 mm over a length of 2.53 mm followed by a conical portion. The auxiliary drum is made of DELRIN (trade name) and the cord is made of nylon and has a diameter of 1.2 mm.

The cylindrical portion of the auxiliary drum 8 may be connected to the winding drum 1 by surfaces of various shapes. This surface may be for example spherical or in the shape of a body of revolution generated by a circular arc at a tangent to the cylindrical portion of the auxiliary drum or by any similar curve.

The diameter of the cylindrical portion of the auxiliary drum preferably ranges between the diameter of the winding drum plus the diameter of the cord and the diameter of the drum 1 plus twice the diameter of the cord.

The portions 1, 8 and 9 may be made in a single piece. The cord does not necessarily have to arrive radially onto the drum.

What is claimed is:

1. A device for winding at least one suspension cord of a blind comprising a winding drum (1), one end of said suspension cord (11) attached to said winding drum, an auxiliary drum means on said winding drum for ensuring that the cord is wound in even turns without overlapping, said auxiliary drum means having a smooth drum portion (8;8') having a diameter which is greater than the diameter of the winding drum (1) and located at a distance from the cord end, a shoulder means (9';9'') on one end of said auxiliary drum means for moving successive cord windings axially away from the shoulder means and onto the auxiliary drum means as the cord windings are formed, and guide means (10) for guiding the cord to be wound onto the shoulder means so that successive cord windings are formed on the auxiliary drum means and are pushed off the opposite end of the auxiliary drum means onto the winding drum under the effect of the shoulder means on the cord.

2. The device of claim 1 wherein said auxiliary drum means has a length measured from said shoulder means to said opposite end being such that tension on the cord is zero in turns (11*b*) leaving said opposite.

3. The winding device as claimed in claim 2, wherein the means (10) for guiding the cord brings the cord substantially radially onto the shoulder means.

4. The winding device as claimed in claim 2, wherein the lateral face of the shoulder means facing the auxiliary drum means is plane and radial.

5. The winding device as claimed in claim 2, wherein the lateral face of the shoulder means facing the auxiliary drum means is conical.

6. The winding device as claimed in claim 5, wherein the conical lateral face (9'*a*) is joined to the smooth drum portion (8') by a rounded portion (16) having a radius which is substantially equal to the radius of the section of the cord to be wound.

7. The winding device as claimed in claim 2, wherein the opposite end of the portion of greater diameter (8') is connected to the winding drum (1) by an at least approximately conical portion(8'*a*).

8. The winding device as claimed in claim 2, wherein the opposite end of the portion of greater diameter is connected to the winding drum by a portion in the shape of a body of revolution generated by a circular arc or a similar curve.

9. The winding device as claimed in claim 2, wherein the opposite end of the portion of greater diameter is joined to the winding drum by a portion having an at least approximately spherical surface.

10. The winding device as claimed in claim 2, wherein the diameter of the portion of greater diameter ranges between the diameter of the winding drum (1) plus the diameter of the cord and the diameter of the winding drum (1) plus twice the diameter of the cord.

11. The winding device as claimed in claim 2, wherein the guiding means are made in one piece with a cradle (14) supporting the winding drum at the shoulder means (9') of the portion of greater diameter.

* * * * *

UNITED STATES PATENT AND TRADEMARK OFFICE

CERTIFICATE OF CORRECTION

PATENT : 5,328,113

DATED : July 12, 1994

INVENTOR(S) : Jean de Chevron Villette et al

It is certified that error appears in the above-identified patent and that said Letters Patent is hereby corrected as shown below:

On the title page, item [75] Inventors: please add the following inventor: --Stephane Plichon, Morillon, France--.

Signed and Sealed this

Twenty-eighth Day of December, 1999

*Attest:*

Q. TODD DICKINSON

*Attesting Officer*

*Acting Commissioner of Patents and Trademarks*